United States Patent [19]

Terry

[11] 4,089,374

[45] May 16, 1978

[54] PRODUCING METHANE FROM COAL IN SITU

[75] Inventor: Ruel C. Terry, Denver, Colo.

[73] Assignee: In Situ Technology, Inc., Denver, Colo.

[21] Appl. No.: 751,135

[22] Filed: Dec. 16, 1976

[51] Int. Cl.[2] ..... E21B 43/24; E21B 43/26

[52] U.S. Cl. ..... 166/259; 166/258; 166/314

[58] Field of Search ..... 166/314, 315, 308, 256–259, 166/261, 271; 299/2, 4, 12

[56] References Cited

U.S. PATENT DOCUMENTS

| | | | |
|---|---|---|---|
| 1,867,758 | 7/1932 | Ranney | 299/2 |
| 2,508,949 | 5/1950 | Howard | 299/2 |
| 3,010,707 | 11/1961 | Craighead et al. | 166/261 X |
| 3,628,929 | 12/1971 | Glass et al. | 166/256 X |
| 3,743,355 | 7/1973 | Blackwell et al. | 166/314 X |
| 3,770,398 | 11/1973 | Abraham et al. | 166/256 X |
| 3,814,480 | 6/1974 | Dahl et al. | 166/308 X |
| 3,865,186 | 2/1975 | Hippel | 166/256 |
| 3,933,447 | 1/1976 | Pasini et al. | 166/256 X |
| 3,934,649 | 1/1976 | Pasini et al. | 166/314 X |
| 3,999,607 | 12/1976 | Pennington et al. | 166/259 |

OTHER PUBLICATIONS

American Gas Assoc. Monthly, "Degasification of Coal Beds — a Commercial Source of Pipeline Gas", vol. 56, No. 1, Jan. 1974, pp. 4–6.

Deul et al., "Coal Beds: a Source of Natural Gas", The Oil and Gas Journal, vol. 73, No. 24, Jun. 16, 1975, pp. 47–49.

*Primary Examiner*—Stephen J. Novosad

[57] ABSTRACT

A well is drilled from the surface of the earth into an underground coal formation. The coal seam is fractured by fluids injected under pressure. Methane entrained in the cracks and fissures is removed to surface facilities. Coal seam in the vicinity of well bore is partially dewatered. Diameter of well bore in the coal section is enlarged first by underreaming the hole, then by a vertical in situ burn to form a collection chimney. Methane desorbed from the coal is withdrawn to surface facilities.

12 Claims, 3 Drawing Figures

PRODUCING METHANE FROM COAL IN SITU

This invention relates to removal of methane from coal in situ. Free methane is removed by means of a drainage well, then desorbed methane is removed through an underground collection chimney created by burning in situ a portion of the coal.

BACKGROUND OF THE INVENTION

The process by which coal is created through geological time is well known and well documented by numerous investigators. Also well known is the face that byproducts of the coalification process include copious quantities of methane and lesser quantities of carbon dioxide, hydrogen and other gases. Virtually all coal seams when opened give off methane, with some coal beds containing as much as 600 standard cubic feet of methane trapped in each ton of coal. Coal may be generally described as a carbonaceous solid material that contains a considerable amount of pore space. Pore space readily visible to the naked eye is commonly called macropore space while that requiring magnification for observation is commonly called micropore space. Methane entrained in coal is located in the macropores (normally cracks and fissures) as free methane and in the micropores as methane adsorbed on to the surfaces of the coal.

Methane, being lighter than air, will freely escape from the macropores when coal is exposed as in an outcrop to the surface of the earth. Methane adsorbed in the micropores will also escape to a substantial degree when coal is exposed but the rate of desorbtion is generally quite slow, and many years of exposure may be required before the desorbtion release of methane is complete.

The coal miners of ancient times had little problem with methane because they were removing coal from outcrops and virtually all of the methane originally entrained in the coal had long since escaped to the atmosphere. When the coal was mined farther and farther underground and away from the outcrop, miners became very much aware of what they called firedamp (principally methane) and blackdamp (principally carbon dioxide) because of the hazardous nature of the gases.

Much research work was done through the years to identify and control the hazards associated with firedamp and blackdamp. Currently the most common control of these hazards is abundant ventilation of underground workings so that the gases emitting from the coal are diluted to safe levels in circulating air that is vented to the atmosphere. While this is an effective safety measure, valuable methane is wasted by dispersal into the atmosphere.

The U.S. Bureau of Mines has performed numerous detailed studies of methane emission from coal. In one recent study (Bureau of Mines Information Circular 8558, 1972) the Bureau reported one coal mine in West Virginia that had an emission of methane exceeding 12 million standard cubic feet per day. Those engaged in the petroleum industry can readily visualize this coal mine as a natural gas reservoir that would be the equivalent of a natural gas field containing a hundred or more commercial gas wells. The problem, of course, if the coal deposit is to be produced as a natural gas reservoir is to attain flow rates into the production wells at commercially acceptable levels.

Among the studies performed by the U.S. Bureau of Mines that have been widely published are Report of Investigations No. 7762 (1973) which deals with the composition of coal seam gas, an article in the American Gas Association Monthly (January 1974) which describes degasification of coal beds as a commercial source of pipeline gas, an article in the Oil and Gas Journal (June 16, 1975) which points to coal beds in the United States as a commercial source of natural gas, and an article in Coal Mining and Processing (October 1976) which reports on methane drainage from five horizontal holes into the Pittsburge seam at a site in West Virginia. In this last named report the Bureau discloses the wells to be 3.5 inches in diameter with average bore length of 1200 feet, with production during a three year period of 770 million standard cubic feet of methane. The Bureau expects these five wells to produce about 600,000 cubic feet per day of methane for 3 more years. The recovered methane is sold to a local natural gas utility which in turn delivers it to its customers as a product undistinguishable from natural gas of petroleum origin.

Draining methane from coal at commercially acceptable withdrawal rates requires large areas of the coal to be exposed. In a relatively thin seam such as the Pittsburgh seam, vertical holes into the seam are generally unrewarding in the commercial sense because of the small surface area exposed to drainage, hence the horizontal holes. Drilling horizontal holes from an outcrop into a coal seam also is generally unrewarding because so much of the methane originally trapped in the coal has already escaped to the atmosphere. The cost of sinking a shaft to an underground coal seam so that horizontal wells may be drilled generally exceeds the sales price of the methane expected to be recovered.

It is an object of the present invention to disclose methods wherein vertical wells are drilled into a coal seam with large areas of coal being exposed to drainage through the production wells. Other objects and advantages of the present invention will become apparent as the description proceeds.

SUMMARY OF THE INVENTION

One or more wells are drilled from the surface of the earth to the top of an underground coal seam. Casing is set in the well bore and cemented in place to provide a hermetic seal. The well is then deepened to the bottom of the coal seam and the coal seam is fractured by injecting a fluid under pressure. Fluids are removed from the well bore permitting the flow therein a free methane entrained under pressure in the cracks and fissures of the coal seam. Free methane is a relatively small part of the total methane content of the coal, the larger part being methane adsorbed in the micropore system of the coal seam. Free methane under formation pressure will migrate rapidly to the lower pressure area of the well bore, moving formation water also to the well bore. Water collecting in the well bore is removed to the surface by artificial lift. When the differential pressure between the formation fluids and the fluid pressure in the well bore is substantially depleted, equipment installed in the well bore is temporarily removed. Well bore diameter in the coal seam is substantially enlarged by underreaming techniques commonly used in the petroleum industry, thus creating a substantially larger surface area of the exposed coal. An oxidizer injection line is installed in the well bore and the coal is ignited. Coal is burned in situ from the bottom of the seam upward until an underground chamber or collection chimney is formed. The products of combustion, being a low BTU fuel gas, are captured at the surface. Combustion of the coal is terminated when the underground chimney is of sufficient size to expose enough coal to permit drainage of desorbed methane at a commercial rate. Water is removed from the bottom of the well at a rate sufficient to prevent significant accumulation.

DESCRIPTION OF THE PREFERRED EMBODIMENT

Figure 1:
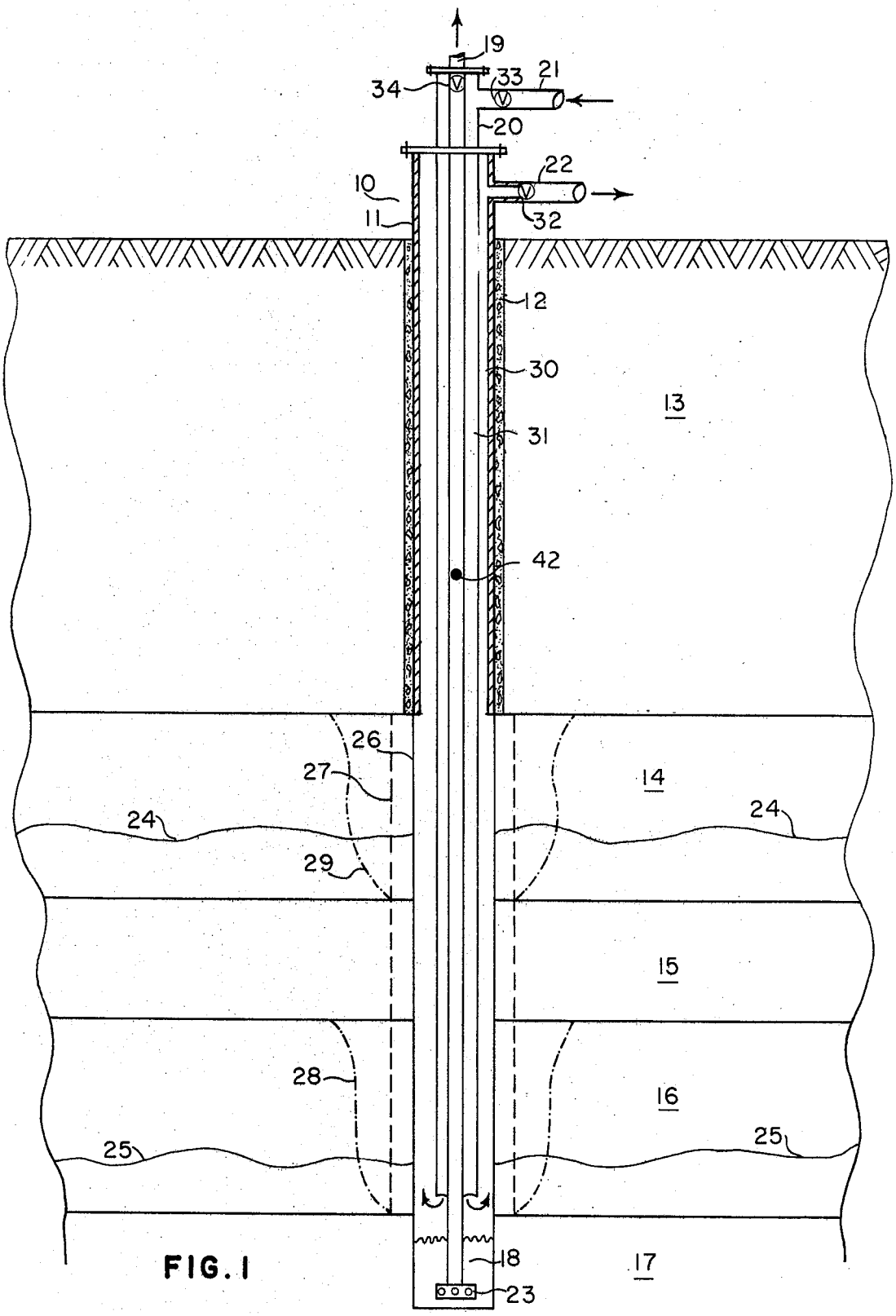
FIG. 1 is a diagrammatic vertical section taken through a section of the earth which shows a well equipped for the methods of the invention. The well penetrates the overburden, and into the underburden.
Figure 2:
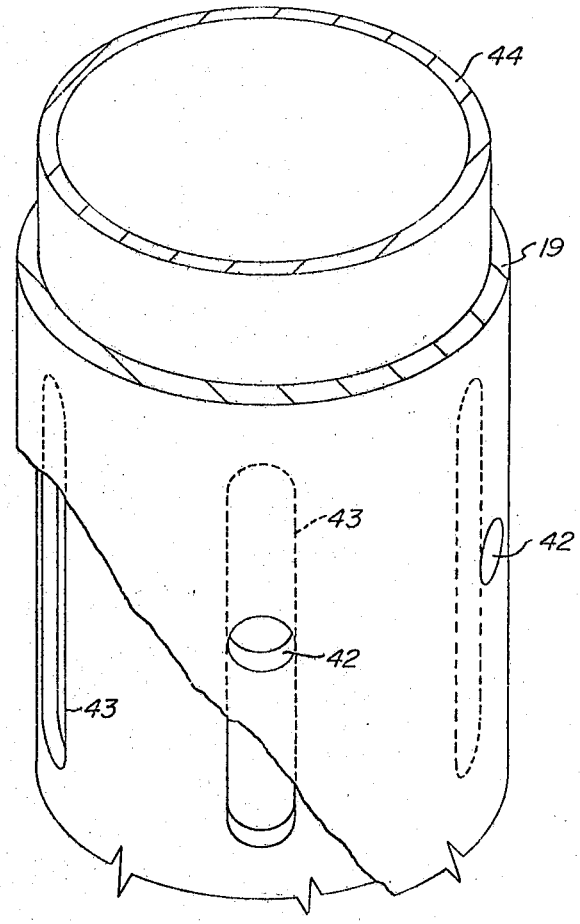
FIG. 2 is a perspective view showing a portion of a pipe with ferforations and a liner containing slots used in the method of the invention.
Figure 3:
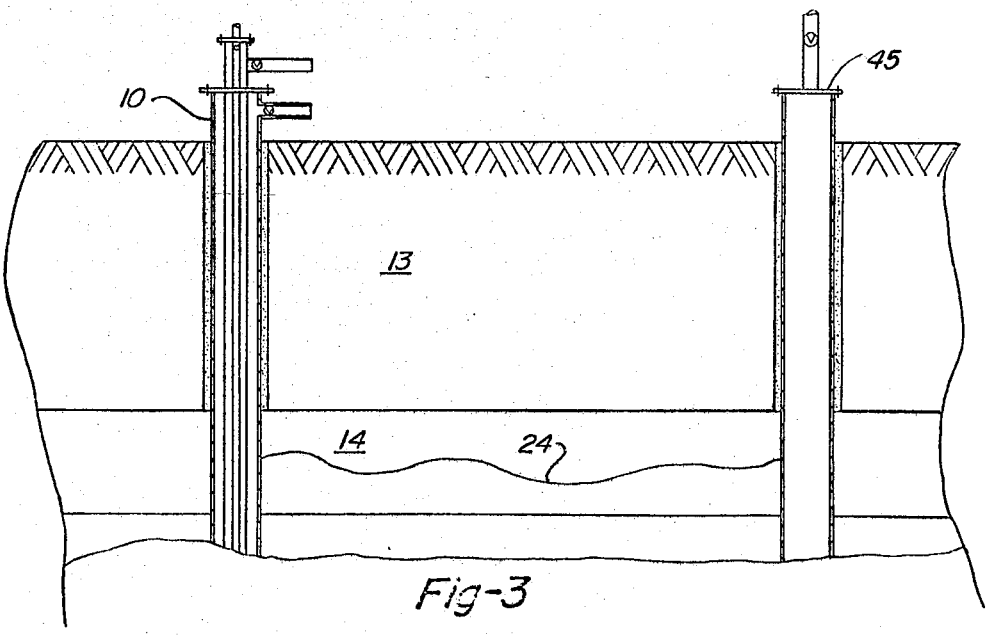
FIG. 3 is a diagrammatic section showing two wells used in the method of the invention.

Coal deposits ideal to the practice of the present invention are located in the Powder River Basin of eastern Wyoming, although coal deposits in many other parts of the world are also good candidates for the methods disclosed. One site of particular interest is located in western Campbell County, wherein there are multiple seams of coal in the interval from 280 feet to 2120 feet below the surface. Within this interval the locally known Canyon seam is about 80 feet thick at about 1150 feet below the surface and the locally known Anderson seam is about 30 feet thick at about 1260 feet below the surface. Both seams are low grade aquifers and both are subbituminous in rank.

Referring to the drawing, a well 10 is drilled from the surface of the earth through overburden 13 to the top of the upper coal seam 14. A casing 11 is set and cemented 12 into place to form a heremetic seal. Casing 11 has attached to it flow line 22. The well is then deepened into coal seam 14 and a fracture 24 is created in the coal seam using techniques commonly practiced in the petroleum industry. The well is deepened through the remainder of coal seam 14, through the interburden 15 and into lower coal seam 16. A fracture 25 is created in the lower coal seam 16 similar to fracture 24 in the upper coal seam. The well is then deepened through the remainder of coal seam 16 and into the underburden 17 to form a sump 18.

The well 10 is then equipped with a water withdrawal pipe 19 which has within it a liner 44 that contains spaced apart slot openings 43 located at the same vertical depth as the perforations 42 in pipe 19. The perforations in pipe 19 could be, for example, ½ inch in diameter and could be spaced apart on the circumference of the pipe an appropriate distance, for example, 2 inches. The vertical slots in the liner could be, for example, ½ inch wide and three inches long and spaced apart on the circumference of the liner an appropriate distance, for example, 2 inches. The outside diameter of the liner is slightly less than the inside diameter of pipe 19 so that the liner is in intimate contact with the pipe but is free to rotate within pipe 19. In this manner the liner may be rotated so that the slots therein may be aligned with the perforations 24 in pipe 19 thereby permitting fluids to flow through perforations 24. Conversely the slots in the liner may be misaligned so that fluid flow through perforations 24 in pipe 19 may be substantially stopped. Pipe 19 contains in fluid communication a pump 23 affixed to the lowermost end of pipe 19. A tubing 20 is installed concentric with pipe 19 with the lower end of the tubing 20 suspended near the bottom of coal seam 16. Tubing 20 has attached to it flow line 21. All contacts among the flow lines, pipe liner, tubing and casing are hermetically sealed so that fluid flows may be controlled without leakage.

In this mode liquids may be removed from the well bore through pump 23 via pipe 19 to the surface of the ground with valve 34 in the open position. A portion of the liquids pumped upward through pipe 19 may be diverted through perforations 24 into annulus 31. Gases in the underground system may be removed by opening valve 32 and permitting the gases to flow under the influence of differential pressure through annulus 30 and through flow line 22. Fluids may be injected into the underground system through flow line 21 by opening valve 33 with flow continuing downward through annulus 31.

At the surface suitable facilities (not shown) are provided to energize pump 23, to separate liquids from gases conveyed through pipe 19, to compress fluids injected through flow line 21, to separate liquids from gases conveyed through flow line 22, and to compress useful gases up to pipeline pressures. Such equipment is of the type commonly used in the petroleum industry.

The process begins with the lower part of well 10 being an open hole of diameter 26 through coal seam 14, interburden 15, coal seam 16 and into underburden 17. With valves 32 and 33 closed, valve 34 is opened and pump 23 is energized. Initially the fluid level consisting principally of liquids in the well bore may be completely to the surface of the ground. Pump 23 should be of sufficient capacity to remove fluids from the well bore so that fluid level may be lowered into and maintained within sump 18.

During the step of lowering the fluid level in the well bore, preferably with valve 32 in the open position, when the fluid level drops to near the top of upper coal seam 14 a surge of gas can fill annulus 30. Production of methane from the coal may then begin by leaving valve 32 in the open position and withdrawing the gas through flow line 22. When the liquid fluid level in the well bore is lowered to the sump, thereby diminishing the hydraulic head pressure on the exposed coal faces, gas flow from the coal into the well bore will rapidly reach a peak level as the gas is removed through flow line 22. This peak flow is deceptively high compared to the sustained flow rate that may be expected later in the production cycle. The peak flow rate is accompanied by a substantial flow of water entrained in the coal which flows both by differential pressure and by gravity into sump 18 for removal to the surface of the ground. The peak flow of methane is a result of the lowered pressure in the well bore compared to the fluid pressure in the cracks and fissures of the two coal seams described above. Due to the limited amount of free methane in the cracks and fissures of the coal located within the effective influence of well 10, pressure of the methane will show a sharp drop from, for example, 500 psia to, for example, 50 psia in a relatively short time period, for example 48 hours. A corresponding drop in water production also will be noted since the differential fluid pressure in the coal seams has substantially diminished, and water flow into well 10 is becoming more dependent on the force of gravity.

Within a period of time, for example two weeks after production began, the well will appear to be dead as a gas producer. It is at this point that the differential pressure of the free methane in the cracks and fissures is substantially depleted and the methane available by desorbtion from the micropores in the coal is inhibited from flowing by residual formation water in the coal.

Since the flow of methane by desorbtion from the coal is a function of the area of coal exposed to a low pressure area, for example the well bore of well 10, this exposed area of coal can be increased by removing installed equipment from well 10 and underreaming the well bore to the maximum practical limit, for example to the diameter designated as 27 in the drawing. The underreaming is accomplished using procedures common in the petroleum industry with cuttings and accumulated fluids removed from the well bore. Installed equipment then is replaced in the well bore as previously described above.

The next phase of the production cycle is begun by igniting the lower portion of coal bed 16 using procedures common in the in situ gasification of coal. Combustion is sustained by injection of an oxidizer, for example air, through flow line 21 into annulus 31 and into the well bore near the ignition point. Products of combustion, sometimes called flue gas, are removed to the surface of the ground through annulus 30 and flow line 22. This flue gas initially will have a calorific content of approximately 150 BTU per standard cubic foot and may be captured at the surface of commercial use.

In situ combustion of the coal continues until an unerground chamber, sometimes called a collection chimney, of sufficient size has exposed an area of coal of the desired magnitude in coal seam 16. Normally the diameter of the well bore can be enlarged at a rate of one inch each four hours of in situ burn time, once the full face of exposed coal is afire. In time the enlargement of the collection chimney will reach a practical limit as designated by 28 on the drawing. This limit will be signalled at the surface by the calorific content of the flue gas showing a decline from, for example, 150 BTU per standard cubic foot to, for example, 50 BTU per standard cubic foot. To facilitate burning out a chimney of desired size it may be necessary to raise the position of the lower end of tubing 20 from time to time so that an adequate amount of oxidizer may be delivered to the burning face of the coal in the upper part of coal seam 16.

For the second phase of the in situ burn, tubing 20 is raised so that its lowermost part is near the bottom of coal seam 14. The exposed face of coal seam 14 has been absorbing heat from the hot flue gases and normally will have an exposed face temperature above the ignition temperature of the coal. Resumption of oxidizer injection through annulus 31 will begin the process of burning an underground chamber in coal seam 14. A collection chimney is then burned in coal seam 14 using methods as described for coal seam 16 above, until the chimney reaches a maximum practical size as illustrated by 29 on the drawing.

During the in situ burn phases described above water accumulating in sump 18 is continuously removed from the well bore. Temperatures in the burn area may reach 2000° F or higher, and thus may cause damage to tubing 20 and in some cases to pipe 19. A cooling effect in the burn area may be attained by aligning the slots in the liner contained within pipe 19 with the perforations 24 in pipe 19. Such alignment will permit a portion of the upward water flow within pipe 19 to be diverted into annulus 31. Water thus diverted falls by gravity and under the influence of differential pressure created by the injected oxidizer and thus proceeds downward in annulus 31. Due to heat transfer through tubing 20, particularly adjacent to the burn area, the water will be substantially all steam when it exits into the well bore from the lower end of tubing 20. Should there be an insufficient supply of water available from sump 18 to provide adequate water for the methods described herein, additional water may be injected from the surface of the ground into water pipe 19. The water thus diverted into annulus 31 serves two purposes, first in cooling the metal parts underground, second in entering into the in situ combustion reaction in the region of the buring coal (sometimes called the reaction zone). Water entering into the combustion reaction will yield hydrogen, carbon monoxide and carbon dioxide. Hydrogen and carbon monoxide, both with a BTU content greater than 300 BTU per standard cubic foot, are useful in enhancing the calorific content of the flue gas. Preferably the water diverted into annulus 31 as described above will be controlled so that a proper amount of water will be available in the reaction zone to maintain the temperature of the reaction zone in the range of 1000° to 1500° F.

In some cases the underground chambers or collection chimneys described in the foregoing may not expose enough coal face areas to permit drainage of methane at a staisfactory sustained rate. In an alternate embodiment, employed preferably during the burn phase in coal seam 16 when the hot exit gases from the in situ burn have heated the exposed coal in coal seam 14 to a temperature above the ignition temperature of the coal, additional coal face areas may be exposed to the underground conduits connected to well 10. In this alternate embodiment a nearby well 45, penetrating adjacent portions of coal seams 14 and 16 and in fluid communication with fractures 24 and 25, is employed as an oxidizer injection well. For clarity of description well 10 is described as the first well and the nearby well is described as the second well. By injecting oxidizer, for example air, into the second well at a pressure greater than the oxidizer injection pressure in the first well, oxidizer can be made to flow from the second well through fractures 24 and 25 into the first well. This flow of oxidizer will cause the fire in the first well to move into fractures 24 and 25 and proceed to burn toward the second well, consuming coal in its path and enlarging the coal face area exposed to fractures 24 and 25. In this mode flue gases from the burns in fractures 24 and 25 are collected and mixed with flue gases in the first well, with the flue gas mixture transported to the surface via annulus 30 of the first well. The burns in fractures 24 and 25 are commonly termed reverse burns. Once the burns in fractures 24 and 25 burn through to the second well and if it is desired to enlarge further the fractures 24 and 25, preferably oxidizer injection in the second well is terminated. Oxidizer injection continues in the first well with the oxidizer release point being positioned so that excess oxidizer may be directed into fractures 24 and 25 with flue gases directed to the surface both via annulus 30 in the first well and through the second well. In this mode the burns through fractures 24 and 25 are commonly termed forward burns.

While the in situ burns consume a portion of the methane contained in the coal, the portion consumed is a relatively small amount of the total methane available. The burns themselves, as previously pointed out, generate a low BTU gas that is useful for commercial purposes. More importantly the burns open up and expose large areas of coal to the communication passages in the coal seams. The burns also serve to dewater the coal seams by consuming water in the in situ combustion reaction, by converting water to steam that is withdrawn to the surface with the flue gases and by providing heat to the coal formation that enhances the evaporation rate of residual water remaining in the coal. The coal deposits as described herein are shrinking coals and upon being heated and dewatered the result is a network of communication passages interconnected with the established communication passages within the coal and into the well bores. These communication passages ultimately extend substantially throughout the coal deposits within the influence of the various wells drilled into the deposits. It is through these communication networks that methane desorbed from the micropore space in the coal is accumulated and under the influence of differential pressure moved to the well bore and on to the surface of the ground.

In situ burns may be terminated by the simple expedient of cutting off the supply of oxidizer. Upon termination of oxidizer injection, in situ combustion will terminate shortly thereafter followed by a period of oxidation of the coal affected until all available oxygen is consumed.

With combustion terminated each production well such as well 10 may be brought on to methane production by continuing the withdrawal of water from sump 18 and by opening valve 22 to permit flow of methane to the surface. Since tubing 20 has served its purpose as an oxidizer injection conduit, tubing 20 is preferably removed from the well bore. Initially the flow rate of methane may be quite small, for example 5,000 standard cubic feet per day, with the rate of flow increasing daily as more and more of the water is removed from the coal deposit thus freeing the micropore network to feed desorbed methane into the coal shrinkage cracks which provide conduits interconnected to production well 10. Stabilized production of methane can reach flow rates in the order of 100,000 to 200,000 standard cubic feet per day over extended periods of time, for example five years or more. Upon completion of methane drainage from coal in the commercial sense, the residual coal deposit with its enhanced permeability is an excellent candidate for further production by means of in situ gasification techniques.

Thus it may be seen that a coal deposit containing entrained and adsorbed methane may be produced as a methane reservoir using the methods disclosed herein.

Although the present invention has been described with a certain degree of particularity, it is understood that the present disclosure has been made by way of example and that changes in detail of structure may be made without departing from the spirit thereof.

What is claimed is:

1. A method of withdrawing methane from an underground coal deposit comprising the steps of establishing a first communication passage between the surface of the earth and an underground coal deposit, setting a casing in the said first communication passage, establishing a hermetic seal between the surface of the earth and the underground coal deposit, establishing three conduit means within the said first communication passage, the first of the said three conduit means being the annulus between the said casing and a tubing installed within the said casing, the second of the said three conduit means being the annulus between the said tubing and a pipe installed within the said tubing, and the third of the said three conduit means being the conduit within the said pipe, establishing a fracture radially outward from the said communication passage and into the said underground coal deposit, deepening the said first communication passage through the lowermost portion of the said underground coal deposit and into the underburden to form a sump, installing pump means in fluid communication with the said pipe, positioning the said pump means within the said sump, removing accumulated liquids from the said first communication passage through the said third conduit means and delivering the said liquids to the surface of the earth, and withdrawing methane from the said underground coal deposit through the said first conduit means.

2. The method of claim 1 further including the steps of removing the said pipe and said pump means from the said first communication passage, removing the said tubing from the said first communication passage, enlarging the diameter of the said first communication passage within the said underground coal deposit, reinstalling the said pipe and the said pump means within the said first communication passage, reinstalling the said tubing within the said first communication passage, removing the accumulated liquids from the said first communication passage through the third conduit means and delivering the said liquids to the surface of the earth, and withdrawing methane from the said underground coal deposit through the said first conduit means.

3. The method of claim 1 further including the steps of positioning the lowermost portion of the said tubing adjacent to the lowermost portion of the said underground coal deposit, igniting the said underground coal deposit, injecting an oxidizer through the said second conduit means, maintaining the liquid level within the said communication passage within the confines of the said sump, burning a collection chimney within the said underground coal deposit, withdrawing the flue gases through the said first conduit means, and capturing the said flue gases at the surface of the earth.

4. The method of claim 3 further including the steps of terminating of said oxidizer injection, terminating the said burning of the said collection chimney, terminating the withdrawal of the said flue gases, and withdrawing methane from the said underground coal deposit through the said first conduit means.

5. The method of claim 3 further including the steps of establishing perforation means in the said pipe, the said perforation means being positioned above the uppermost portion of the said underground coal deposit, installing a liner within the said pipe, said liner containing slot means postioned to act in concert with the said perforation means in the said pipe, and the outermost portion of the said liner being in intimate contact with the innermost portion of the said pipe, positioning the said liner within the said pipe so that the said perforations in the said pipe are aligned with the said slots in the said liner, and diverting a portion of the liquids in the said pipe into the said second conduit means.

6. The method of claim 5 further including the step of regulating the said diversion of a portion of the liquids into the said conduit means in order to control temperatures in the said burning of a collection chimney.

7. The method of claim 6 wherein temperatures in reaction zone are maintained within the range of 1000° to 1500° F.

8. The method of claim 3 further including the steps of establishing a second communication passage apart from the said first communication passage, the said second communication passage being between the surface of the earth and the said underground coal deposit, the said second communication passage also being in fluid communication with the said fracture extending radially outward from the said first communication passage, injecting an oxidizer into the said second communication passage and through the said fracture and into the said first communication passage, drawing a portion of the fire from the said first communication passage into the said fracture and onto the said second communication passage, withdrawing the flue gases from the fire in the said first communication passage and from the fire in the said fracture through the said first conduit means, and capturing the said flue gases at the surface of the earth.

9. The method of claim 8 further including the step of terminating injection of oxidizer into the said first communication passage, terminating injection of oxidizer into the said second passage, terminating burning of the said collection chimney, terminating burning of the said fracture, terminating withdrawal of the said flue gases, and then withdrawing methane from the said underground coal deposit through the said first conduit means in the said first communication passage.

10. The method of claim 8 further including the steps of terminating oxidizer injection into the said second passage, propagating the fire in the said fracture by diverting a portion of the said oxidizer injected into the said first communication passage through the said fracture, collecting the flue gases from the said fracture into the said second communication passage, withdrawing the said flue gases from the second communication passage, and capturing the said flue gases at the surface of the earth.

11. The method of claim 10 further including the steps of terminating oxidizer injection into the said first communication passage, terminating burning of the said collection chimney, terminating burning of the said fracture, terminating collection of the said flue gases, and then withdrawing methane from the said underground coal deposit through the said first conduit means in the said first communication passage.

12. The method of claim 11 further including the step of withdrawing a portion of the methane from the said underground coal deposit through the said second communication passage.

* * * * *